United States Patent [19]

Bosley

[11] 4,026,098

[45] May 31, 1977

[54] PRODUCTION OF YARN OF POLYESTER FILAMENTS HAVING A RANDOM DISTRIBUTION ALONG THE FILAMENT LENGTH OF THICK AND THIN SECTIONS DIFFERING IN DYEABILITY

[75] Inventor: David Emerson Bosley, Grifton, N.C.

[73] Assignee: E. I. Du Pont de Nemours and Company, Wilmington, Del.

[22] Filed: Feb. 26, 1976

[21] Appl. No.: 661,634

[52] U.S. Cl. ..... 57/157 TS

[51] Int. Cl.[2] ..... D02G 1/02

[58] Field of Search ..... 57/36, 37, 38.3, 38.4, 57/39, 51.2–51.6, 157 S, 157 TS, 140 J; 264/290 N, 290 T, 167

[56] References Cited

UNITED STATES PATENTS

| | | | |
|---|---|---|---|
| 3,094,834 | 6/1963 | Deeley et al. | 57/157 TS X |
| 3,117,173 | 1/1964 | Adams | 57/140 J |
| 3,127,915 | 4/1964 | Bottomley et al. | 57/140 J |
| 3,275,732 | 9/1966 | Macleod et al. | 264/167 X |
| 3,478,143 | 11/1969 | Werner et al. | 264/290 T |
| 3,835,632 | 9/1974 | Kishida et al. | 57/157 TS X |
| 3,939,637 | 2/1976 | Franz et al. | 57/140 R |

FOREIGN PATENTS OR APPLICATIONS

| | | | |
|---|---|---|---|
| 730,353 | 3/1966 | Canada | 264/290 T |

*Primary Examiner*—Donald Watkins

[57] ABSTRACT

Yarn of polyester filaments having a random distribution along the filament length of thick and thin sections, which differ in dye uptake, is produced by incompletely drawing a spin-oriented yarn, preferably one prepared by melt-spinning polyethylene terephthalate into yarn while withdrawing the yarn from the spinneret at a take-off speed of 3000 to 4000 yards per minute. The spin-oriented yarn is drawn on a hot draw pin of about 1.3 to 6 cm in diameter, using a draw ratio which is 82 to 95 percent of the draw ratio needed to fully draw the yarn. The incompletely drawn yarn can be false-twist textured under conditions conventionally used for fully drawn polyester yarn. The textured yarn provides attractive dyed fabrics due to darker shades of color in the thick filament sections.

1 Claim, No Drawings

PRODUCTION OF YARN OF POLYESTER FILAMENTS HAVING A RANDOM DISTRIBUTION ALONG THE FILAMENT LENGTH OF THICK AND THIN SECTIONS DIFFERING IN DYEABILITY

BACKGROUND OF THE INVENTION

This invention relates to production of false-twist textured yarn of polyester filaments, and is more particularly concerned with yarns of polyester filaments having a random distribution of thick and thin sections which differ in dye uptake.

Conventional processes for producing textile yarns of polyester filaments have involved melt-spinning polyethylene terephthalate into yarn at take-off speeds of 550 to 1640 yards per minute (500 to 1500 meters/minute). The take-off speed refers to the speed of the solidified yarn at windup or a roll for forwarding the yarn to subsequent processing. This as-spun yarn is usually drawn at a draw ratio of about 3.5 to 4.5× (3.5 to 4.5 times greater length) to produce the fully-drawn, uniform yarn of commerce.

Conventional as-spun yarn can be drawn to provide a random distribution of thick and thin sections along the filaments, of which the thick sections have a higher dye uptake (dye to darker shades) and provide attractive dyed fabrics.

Werner et al. U.S. Pat. No. 3,478,143 discloses such a process in which conventional as-spun yarn is incompletely drawn on a draw pin of about 1.5 to 6 cm in diameter maintained at a temperature of 60° to 105° C (preferably 65° to 85° C), using a draw ratio of about 60 to 80 percent, preferably 66 to 74 percent, of the draw ratio normally used for producing uniform fully drawn yarn. However, yarns produced in this way have not been suitable for producing textured (crimped) yarn by modern false-twist texturing processes because the thick sections stick or melt on contacting the texturing heater used to set twist in the yarn. Heater temperatures above 200° C are needed to obtain satisfactory crimp properties.

Petrille U.S. Pat. No. 3,771,307 discloses that polyester yarn can be false-twist textured under conventional conditions, at heater plate temperatures of 227° C to produce excellent textured products when using spin-oriented yarn prepared by melt-spinning at take-off speeds of 3000 to 4000 yarns per minute (2744 to 3660 meters/minute). The as-spun yarn is drawn at a draw ratio of 1.3 to 2.0 which is sufficient to provide a fully drawn, uniform yarn. The patent does not refer to production of thick and thin sections along the filaments. Schippers German OS Patent No. 2,204,397 (laid open Aug. 9, 1973) discloses melt-spinning polyester yarn at take-off speeds higher than 3000 meters/minute (3280 yards/minute) to form a spin-oriented yarn which is then drawn at a draw ratio in the range of 1.3 to 1.8× to produce a fully drawn product. The process is said to avoid denier variations caused by local instability of the draw point when yarn is spun at conventional take-off speeds of 500 to 1500 meters per minute (550–1640 yards/minute). The patent teaches that no well defined and therefore locally determined draw point forms when drawing the spin-oriented yarn, and that hot pins are not required.

SUMMARY OF THE INVENTION

The present invention provides a process for producing polyester filament yarn which has a random distribution along the filament length of thick and thin sections differing in dyeability, and which is suitable for false-twist texturing at heater temperatures greater than 200° C.

In the process of this invention, as-spun spin-oriented polyester yarn is drawn on a draw pin of about 1.3 to 6 cm in diameter maintained at 60° to 90° C, using a draw ratio which is 82 to 95 percent of a draw ratio that would fully draw the yarn. As used herein, "spin-oriented polyester yarn" refers to continuous filament yarn prepared by melt-spinning polyester and withdrawing the yarn from the spinneret at a take-off speed greater than 3000 yards/minute (2740 meters/minute).

Preferably the spin-oriented yarn is prepared by melt-spinning polyethylene terephthalate into yarn while withdrawing the yarn from the spinneret at a take-off speed of 3000 to 4000 yards/minute as disclosed in Petrille U.S. Pat. No. 3,771,307. However, take-off speeds greater than 4000 yards/minute (3660 meters/minute) can be used, and polyesters consisting essentially of linear glycol terephthalate polymer are suitable. The polyester may contain the usual delustrants, particulate matter, antistats, optical brighteners, antioxidants and copolyester components.

Preferably the spin-oriented yarn will draw to a fully-drawn, uniform yarn having a break elongation of less than 40 percent when drawn at a draw ratio within the range of 1.3 to 1.8×.

The incompletely drawn polyester yarn produced by the process of this invention can be false-twist textured by conventional processes used for fully drawn polyester yarn, with heater temperatures greater than 200° C, to produce textured yarn having good bulk. No melting of the thick sections occurs. The textured yarn provides attractive dyed fabrics due to deeper dyeing of the randomly spaced thick sections of the yarn. The drawing process is preferably combined with the false-twist texturing process in a tandem draw-texturing process in which the spin-oriented yarn is incompletely drawn in a draw zone and is then textured in a false-twist texturing zone.

DETAILED DESCRIPTION

The drawing process of this invention is performed on conventional equipment, preferably using a draw pin having a surface of "alsimag" (a ceramic composition produced by the 3M Company). The draw pin of about 1.3 to 6 cm in diameter is maintained at a temperature within the range of 60° to 90° C, the higher temperatures being used at high running speeds. At yarn speeds greater than about 500 yards/minute (457 meters/minute, the draw pin temperature is preferably about 80° to 90° C. The speeds of the draw rolls are adjusted to incompletely draw the yarn. The draw ratio should be from 82 to 95 percent of the draw ratio normally used to fully draw the yarn. The resulting incompletely drawn yarn has thick and thin sections randomly spaced along the yarn length. The thick sections of the filaments have cross-sectional areas which are less than two times that of adjacent sections along the length of the filament. The draw ratio selected depends upon the appearance desired in dyed fabric prepared from the yarn. The lower draw ratios provide very numerous deep-dyed thick sections. The frequency of thick sections decreases at higher draw ratios, and none are found in a fully drawn yarn.

The incompletely drawn yarn can be false-twist textured on a conventional machine such as the Leesona machine disclosed in Chalfant et al. U.S. Pat. No. 3,292,354. Alternatively, the drawing process and the false-twist texturing process can be performed on a single machine which has a draw zone immediately before the bottom feed roll leading to the false-twist texturing zone. The drawing process must be completed before the incompletely drawn yarn is exposed to the texturing heater. Tandem draw-texturing machines are available which can be modified to incompletely draw the spin-oriented yarn in accordance with the present invention.

Measurements indicated in the examples are determined as follows:

Break Elongation and Tenacity are measured according to the ASTM designation D-2256-69 (incorporating editorial edition of Section 2 and renumbering of subsequent sections as done in March 1971). It is defined as in Option 3.3 "Elongation at Break" of Section 3. The testing is performed on straight multifilament yarns which were conditioned by storing them at 65 percent relative humidity and 70° F (21.1° C) for 24 hours prior to testing. An Instron Tensile Testing Machine is used. The test sample is 5 inches (12.7 cm) long, no twist is added, the cross-head speed is 10 inches/minute (25.4 cm/min), the rate of attenuation is 200 percent/minute, and the chart speed is 5 inches/minute (12.7 cm/min). Tenacity is the maximum load in grams, before the yarn breaks, divided by the denier of the yarn.

Boil-Off Shrinkage is obtained by suspending a weight from a length of yarn to produce a 0.1 gm/denier load on the yarn and measuring its length ($L_o$). The weight is then removed and the yarn is immersed in boiling water for 30 minutes. The yarn is then moved, loaded again with the same weight, and its new length recorded ($l_f$). The percent shrinkage is calculated by using the formula:

$$\text{Shrinkage (\%)} = (L_o - L_f)/L_o \times 100$$

Relative Viscosity (RV) values of the polyesters used in the examples are given as a measure of the molecular weight. Relative Viscosity (RV) is the ratio of the viscosity of a solution of 0.8 gm of polymer dissolved at room temperature in 10 ml of hexafluoroisopropanol, to the viscosity of the hexafluoroisopropanol itself, both measured at 25° C in a capillary viscometer and expressed in the same units.

EXAMPLE I

A 245-denier polyester yarn is prepared by melt-spinning at 288° C polyethylene terephthalate of 22 relative viscosity, using a spinneret having 34 round orifices (each orifice 9 mils diameter, 12 mils deep) and winding the filaments at 3400 yds/min. (3110 meters/min) The yarn has a tenacity of 2.35 gpd, a break elongation of 142 percent and boil-off shrinkage of 55 percent. This yarn is drawn 1.706× in a separate step on a Whitin RK drawwinder at 454 yds/min (415 mpm) windup speed. In the draw zone the yarn takes one wrap around a 1.6-inch (4.1 cm) diameter draw pin heated to 90° C. The yarn contains filaments having thick and thin sections. Each thick section is about one-quarter inch to one-half inch (6 to 12 mm) long and has a cross-sectional area which is about 1.8× that of adjacent sections along the length of the filament. The drawn yarn is textured on an ARCT FTFL 440B false-twist texturing machine using the following conditions: 0% 2nd overfeed, +14 percent third overfeed, 0% supplementary overfeed, and −4 percent takeup overfeed; 60 turns per inch (2360 turns/meter); 247,323 rpm spindle speed; 210° C 1st heater; 230° C 2nd heater; and a cooling zone stringup. No melting occurs in the texturing zone. The yarn has good bulk. The textured yarn is knit into a circular tubing on a Lawson FAK machine and dyed with Latyl Blue FLW (Disperse Blue 27) dye. The resulting fabric showed 20–30 deep-dyed streaks per square inch (3 to 5 per cm²) each streak being about 0.1 to 0.2-inch (2 to 5 mm) long. Microscopic examination of the yarns in the deep-dyed sections showed that there were both thin filament sections that dyed lighter and thick filament sections that dyed deeper. The fabric is very attractive.

EXAMPLE II

Polyethylene terephthalate is melt-spun at 285° C using a spinneret containing 34 round orifices of 15-mil (0.38 mm) diameter and 60 mil (1.52 mm) depth. The freshly spun filaments travel in air approximately 60 inches (152 cm) before they contact a finish applying roll, after which they pass over process rolls and are wound up at 3500 yards/min (3200 meters/min) as 250-denier yarn of 22 relative viscosity polyester. The yarn has a boil-off shrinkage of greater than 60 percent and it is highly oriented and substantially amorphous. It has a tenacity of about 2.4 gpd and a break elongation of about 145 percent.

Four samples (coded A, B, C and D) of this yarn are draw-textured by the tandem process on a Leesona 570 to which a draw zone is attached immediately before the bottom feed roll. The 1.6-inch (4.1 cm) diameter draw pin is at 80° C and the draw ratio for each sample is shown in Table I. The heater plate in the texturing zone is at the conventional temperature of 205° C. No melting of the thick sections occurs. Spindle speed is 270,000 rpm to produce in the yarn 66 turns per inch (2598 turns per meter) twist in the twist zone. Overfeeds are as follow: bottom +1 percent, top −4 percent, relaxing zone 12¼ percent. The heater setting is at 200° C. The textured yarn contains filaments having thick and thin sections along its length. Each thick section is about one-sixteenth inch to one-eighth inch (about 0.16 to 0.32 cm) long and has a cross-sectional area which is less than two times that of adjacent sections. Each textured yarn is knit into a jersey stitch circular knit tube on a Lawson knitter. Sections of each knit fabric, after scouring, are dyed with Latyl Brilliant Blue BG dye. Each dyed fabric is rated as follows:

TABLE I

| Sample Identification | Draw Ratio | Rating |
|---|---|---|
| A | 1.50 | Very numerous thick sections; not as attractive as "B" and "C" |
| B | 1.60 | Fewer thick sections than A; quite attractive |
| C | 1.70 | Very pretty fabric; thick sections |
| D | 1.80 | No thick sections. |

EXAMPLE III

Polyethylene terephthalate is melt-spun at 283° C using a spinneret containing 34 round orifices of 15 mil (0.38 mm) diameter and 60 mils (1.52 mm) depth. The freshly spun filaments travel in air approximately 60 inches (about 152 cm) before contacting a finish-applying roll. The yarn then passes over other process rolls and is wound up at 3420 yards/min (3127 meters/-min) as 245 (approximate) denier yarn of 20 relative viscosity polyester. The yarn has a boil-off shrinkage of about 58 percent, a break elongation of about 140 percent, a tenacity of about 2.4 gpd and is substantially amorphous.

Three of the new yarns are prepared by drawwinding this spin-oriented supply at each of three different machine draw ratios shown in Table II on a RD drawwinder (Whitin Machine Works, Whitinsville, Mass.) using one (360° ) wrap on an 83± 2° C, 1.6 inch (4.1 cm) pin, and a draw speed of 454 ypm (415 mpm) to provide thick and thin sections along the filaments.

Each drawn yarn is knit into a jersey stitch circular knit tube on a Lawson Knitter. Sections of each tube are cut from the tube and dyed in red, blue, or yellow disperse baths. The resulting dyed tubes have attractive deep-dyed sections randomly spaced in the fabric. Ratings of each are shown in Table II.

TABLE II

| Sample | 1 | 2 | 3 |
|---|---|---|---|
| Draw Ratio | 1.483 | 1.593 | 1.706 |
| Subjective Rating* | 5 | 4 | 2 |

*Fabric rating: ranging from "5" representing fabric having very frequent often intense dyed sections to "1" representing fabric having no deeply-dyed sections.

Each drawn yarn is also false-twist textured on a 440 ARCT machine using the following conditions: 210° C bottom heater; 230° C top heater; 3 mm diameter sapphire spindle; 247,323 rpm spindle speed to produce 60 turns per inch (2362 turns/meter) in the yarn; overfeeds: bottom 0 percent; second (second heater) +14 percent; take up −4 percent. The resulting textured yarns are knit into double knit fabrics which, after finishing, have the bulky pleasant handle associated with textured yarns. Swatches of each finished fabric are dyed with mixtures of widely used red and yellow dyes to give attractive fabrics. The dyed fabrics have exciting, unique and attractive deeply-dyed sections, randomly spaced in them. Ratings are the same as in Table II.

I claim:

1. In the production of yarn of polyester filaments having a random distribution along the filament length of thick and thin sections differing in dyeability, by incompletely drawing as-spun yarn on a draw pin of about 1.3 to 6 cm. in diameter maintained at 60° to 90° C.; the improvement for producing a textured yarn which comprises drawing a spin-oriented polyester yarn at 82 to 95 percent of a draw ratio that would fully draw the yarn and then false-twist texturing the incompletely drawn yarn at a heater temperature greater than 200° C. for heat-setting twist in the yarn.

* * * * *